US010252270B2

(12) United States Patent
Weierstall et al.

(10) Patent No.: US 10,252,270 B2
(45) Date of Patent: Apr. 9, 2019

(54) NOZZLE APPARATUS AND METHODS FOR USE THEREOF

(71) Applicants: Uwe Weierstall, Phoenix, AZ (US); Dingjie Wang, Tempe, AZ (US); John Spence, Tempe, AZ (US)

(72) Inventors: Uwe Weierstall, Phoenix, AZ (US); Dingjie Wang, Tempe, AZ (US); John Spence, Tempe, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 0 days.

(21) Appl. No.: 15/509,376

(22) PCT Filed: Sep. 8, 2015

(86) PCT No.: PCT/US2015/048820

§ 371 (c)(1),
(2) Date: Mar. 7, 2017

(87) PCT Pub. No.: WO2016/040243

PCT Pub. Date: Mar. 17, 2016

(65) Prior Publication Data

US 2017/0274380 A1 Sep. 28, 2017

Related U.S. Application Data

(60) Provisional application No. 62/047,118, filed on Sep. 8, 2014, provisional application No. 62/095,677, filed on Dec. 22, 2014.

(51) Int. Cl.
*B05B 7/00* (2006.01)
*B01L 3/00* (2006.01)
(Continued)

(52) U.S. Cl.
CPC .... *B01L 3/502776* (2013.01); *B01F 3/04007* (2013.01); *B01F 3/0865* (2013.01);
(Continued)

(58) Field of Classification Search
CPC ..... B05B 7/0807; B05B 7/06; B05B 7/061; B05B 7/062; B05B 7/065; B05B 7/066; B05B 7/08
(Continued)

(56) References Cited

U.S. PATENT DOCUMENTS 3,770,207 A * 11/1973 Muller ..... B05B 7/061 239/397.5
3,980,233 A * 9/1976 Simmons ..... F23D 11/107 239/400
(Continued)

OTHER PUBLICATIONS

The International Search Report (ISR) with Written Opinion for PCT/US2015/048820 dated Nov. 30, 2015, pp. 1-12.

*Primary Examiner* — Viet Le
(74) *Attorney, Agent, or Firm* — Michael Best & Friedrich LLP

(57) ABSTRACT

Nozzle Assemblies and methods of use for producing a liquid jet are disclosed that may be permit adjustable time delays between mixing of fluids and observation of reactions. An example nozzle assembly includes: a housing having an inlet and an outlet and a first channel defined therebetween, where the housing includes a gas focusing aperture defining the housing outlet; an intermediate tube disposed within the first channel of the housing, where the intermediate tube has an inlet and an outlet and defines a second channel therebetween; and a central tube disposed within the second channel of the intermediate tube, where the central tube has an inlet and an outlet and defines a third channel therebetween, where the central tube outlet is longitudinally spaced apart from the intermediate tube outlet
(Continued)

such that the intermediate tube outlet is disposed between the central tube outlet and the gas focusing aperture's inlet.

18 Claims, 7 Drawing Sheets

(51) Int. Cl.
*B01F 5/04* (2006.01)
*B01F 13/00* (2006.01)
*B01F 3/04* (2006.01)
*B01F 3/08* (2006.01)
*B05B 7/32* (2006.01)

(52) U.S. Cl.
CPC ..... *B01F 5/045* (2013.01); *B01F 13/0062* (2013.01); *B01F 13/0093* (2013.01); *B01L 3/5027* (2013.01); *B05B 7/32* (2013.01); *B01F 2215/0037* (2013.01); *B01F 2215/0431* (2013.01); *B01L 2200/0636* (2013.01); *B01L 2300/0832* (2013.01); *B01L 2300/0858* (2013.01); *B01L 2300/0867* (2013.01)

(58) Field of Classification Search
USPC ..... 239/290, 548, 398–434.5
See application file for complete search history.

(56) References Cited

U.S. PATENT DOCUMENTS 4,361,285 A * 11/1982 Koppehele ..... B05B 1/265 239/424
4,807,814 A * 2/1989 Douche ..... B05B 7/1486 239/428
4,977,785 A * 12/1990 Willoughby ..... H01J 49/0445 239/86
5,273,212 A * 12/1993 Gerhardus ..... C01B 3/363 239/132.3
5,332,512 A * 7/1994 Wells ..... G01N 1/38 210/434
5,573,392 A * 11/1996 Paikert ..... F23D 11/107 431/10
5,580,237 A * 12/1996 Leger ..... C21C 5/4613 239/425
5,845,846 A * 12/1998 Watanabe ..... B05B 7/061 239/8
5,941,459 A * 8/1999 Brooker ..... C10J 3/485 239/397.5
5,954,491 A * 9/1999 Helton ..... F23D 1/005 239/132.3
6,228,224 B1 * 5/2001 Brooker ..... B01J 7/00 202/217
6,284,324 B1 * 9/2001 Whittaker ..... C23C 4/06 204/192.1
6,352,209 B1 * 3/2002 Skeath ..... B05B 1/08 239/8
6,435,004 B1 * 8/2002 Miller ..... G01N 1/38 73/23.2
6,520,425 B1 * 2/2003 Reneker ..... B05B 7/061 239/294
6,755,355 B2 * 6/2004 Whittaker ..... C10J 3/506 239/132
6,805,773 B1 * 10/2004 Brooker ..... C10J 3/00 202/217
6,860,907 B1 * 3/2005 Hanna ..... A61K 9/1688 23/300
7,926,282 B2 * 4/2011 Chew ..... F23D 11/107 239/403
7,926,744 B2 * 4/2011 Thomson ..... F23R 3/28 239/405
7,967,221 B2 * 6/2011 Snyder ..... B05B 7/0416 239/418
7,993,131 B2 * 8/2011 Douglas ..... C10J 3/485 110/235
8,186,164 B2 * 5/2012 Cowan ..... F23D 17/002 60/740
8,348,180 B2 * 1/2013 Mao ..... F23D 11/107 239/403
8,607,571 B2 * 12/2013 Williams ..... F23R 3/286 60/740
8,646,275 B2 * 2/2014 Rackwitz ..... F23R 3/343 60/737
8,746,965 B2 * 6/2014 Livshits ..... B01F 5/0057 261/76
8,783,585 B2 * 7/2014 Steinhaus ..... C10J 3/506 239/419
8,893,500 B2 * 11/2014 Oskam ..... F23R 3/286 60/737
8,919,132 B2 * 12/2014 Oskam ..... F23R 3/36 60/737
9,091,444 B2 * 7/2015 Turrini ..... F23R 3/286
9,134,023 B2 * 9/2015 Boardman ..... F23C 7/004
9,144,774 B2 * 9/2015 Livshits ..... B01F 3/04446
9,188,063 B2 * 11/2015 Prociw ..... F23R 3/28
9,862,900 B2 * 1/2018 Abraham ..... C10J 3/54
9,927,126 B2 * 3/2018 Benjamin ..... F23R 3/343
2002/0175225 A1 * 11/2002 Boersen ..... B05B 7/061 239/506
2003/0124193 A1 * 7/2003 Snyder ..... A61K 9/0075 424/489
2004/0140374 A1 * 7/2004 Snyder ..... B05B 7/0416 239/418
2012/0145900 A1 * 6/2012 Chen ..... G01N 23/2251 250/311

* cited by examiner

NOZZLE APPARATUS AND METHODS FOR USE THEREOF

CROSS-REFERENCE TO RELATED APPLICATIONS

This application claims the benefit of the filing date of International PCT Application No. PCT/US15/48820, filed Sep. 8, 2015, that claims priority to U.S. Provisional Patent Application Ser. No. 62/047,118, filed Sep. 8, 2014, and U.S. Provisional Patent Application Ser. No. 62/095,677, filed Dec. 22, 2014, which are hereby incorporated by reference in their entirety.

STATEMENT OF GOVERNMENT FUNDING

This invention was made with government support under 1120997 and 1231306 awarded by the National Science Foundation and under R01 GM095583 awarded by the National Institute of Health. The government has certain rights in the invention.

BACKGROUND

Kinetic studies of conformational changes of macromolecules provide valuable information on the function and dynamics of biomolecules. A thorough study of reaction kinetics requires knowledge of the transient state of molecules during conformational changes. This necessitates the investigation of molecular structure at various time points, as in time-resolved crystallography, often based on pump-probe methods.

In chemical processes, such as a substrate-enzyme interaction, or protein folding or unfolding, mixing of two liquids or solutions initiates a reaction. The fast nature of some conformational changes, e.g. protein folding or unfolding, calls for new experimental methods that access rapid time scales. Several techniques have been adopted in the past, such as photochemical triggering, temperature/pressure jump and rapid fluid mixing.

X-ray Free Electron Lasers (XFELs) have opened up new opportunities for crystallography due to the ability to outrun radiation damage in a "diffract-before-destroy" read-out mode, and may also allow diffraction measurements with very high time-resolution at room temperature where multiple copies of a sample can be provided. XFELs may provide 1012 photons per 50 fs hard-Xray pulse, currently at a pulse repetition rate of 120 Hz. The requirements for sample delivery in XFEL experiments, such as high replenishment rate in a hydrated environment in vacuum thus pose challenges for existing closed cell liquid mixing methods. Turbulent mixing may achieve extremely fast mixing times, but high sample consumption limits its utility for most biological samples. The extremely short and fixed mix-to-probe delay time also limits its application to measure full reaction time courses. Microfluidic devices can usually be ruled out due to the extremely bright XFEL beam, which vaporizes any material in its path.

Accordingly, a need exists for an apparatus and a method for allowing time-resolved spectroscopy for the study of chemical kinetics.

SUMMARY

Exemplary embodiments of nozzle assemblies are described, the nozzle assemblies allowing mixing of two liquids inside the nozzle(s) and then forming a free jet in ambient conditions or vacuum. This may beneficially achieve fast mixing and an adjustable time delay, while addressing requirements of XFEL experiments, for example. In some embodiments the mixing is diffusive, and in some embodiments the diameter of the free jet may be about 5 microns. In an exemplary embodiment, the mixing time may be on the order of 250 microseconds and the time delay between free jet formation and mixing may be adjusted. As will be described in more detail later, in various embodiments this time delay may be adjusted by changing the relative positions of nozzle components. These adjustments to the nozzles may be manually implemented or mechanically implemented (e.g. using micromanipulators, stepper motors, piezo transducer or manual adjustment by pulling/pushing the capillary inside a capillary sleeve). In contrast to known microfluidic mixers, nozzle assemblies according to the invention form a free liquid jet in air or vacuum that allow for adjustable time delays between mixing and jet formation. In still other embodiments, control of pressure and/or flow rates of the liquids and gas may be adjusted so as to control the time delay between mixing and free jet formation. The nozzle assemblies according to the invention may beneficially enable studies of biomolecular conformational changes due to reaction with another molecule at different time delays between mixing and observation (e.g. enzyme reactions).

Furthermore, methods for producing a liquid jet that may permit time-resolved study of chemical kinetics using a nozzle assembly directing the liquid jet at an X-ray beam are disclosed. The methods may achieve mixing of substrates and enzymes in the liquid jet within a desired time period and may allow for a controllable time delay between mixing of the liquid and probing of the liquid jet via an analysis beam, such as an X-ray beam. In some embodiments the mixing of fluids may be uniform and may be fast, occurring within 250 μs, for example. The mixing time may then set the time resolution of the structural measurements, which in some embodiments may use femtosecond pulses of an X-ray laser, though other X-ray sources may also be used. These short pulses may outrun radiation damage, allowing the study of protein molecules or nanocrystals at room temperature thereby alleviating concerns of damage due to freezing.

Thus, in one aspect, a nozzle assembly is provided having (a) a housing having an inlet and an outlet and a first channel defined therebetween, where the housing includes a gas focusing aperture that defines the outlet of the housing, (b) an intermediate tube disposed within the first channel of the housing, where the intermediate tube has an inlet and an outlet and defines a second channel therebetween and (c) a central tube disposed within the second channel of the intermediate tube, where the central tube has an inlet and an outlet and defines a third channel therebetween, where the outlet of the central tube is longitudinally spaced apart from the outlet of the intermediate tube such that the outlet of the intermediate tube is disposed between the outlet of the central tube and an inlet of the gas focusing aperture.

In a second aspect, a method for producing a liquid jet is provided including the steps of (a) injecting a first fluid into the inlet of the housing of the nozzle assembly according to the first aspect and thereby advancing the first fluid through the first channel of the housing, (b) injecting a second fluid into an inlet of the intermediate tube and thereby advancing the second fluid through the second channel of the intermediate tube, (c) injecting a third fluid into an inlet of the central tube and thereby advancing the third fluid through the third channel of the intermediate tube and (d) combining the second fluid and the third fluid in a mixing region in the intermediate tube between the outlet of the central tube and the outlet of the intermediate tube.

These as well as other aspects, advantages, and alternatives, will become apparent to those of ordinary skill in the art by reading the following detailed description, with reference where appropriate to the accompanying drawings.

BRIEF DESCRIPTION OF THE DRAWINGS

To facilitate further description of the embodiments, the following drawings are provided in which.

DETAILED DESCRIPTION

Example embodiments of a nozzle assembly and methods for making liquid metal pipes are described herein. Any example embodiment or feature described herein is not necessarily to be construed as preferred or advantageous over other embodiments or features. The example embodiments described herein are not meant to be limiting. It will be readily understood that certain aspects of the disclosed apparatus and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

As used herein, with respect to measurements, "about" means +/−5%.

As used herein, "mix-to-probe time delay" refers to the time it takes for the fluid from a central tube after mixing with a fluid from an intermediate tube in a mixing region to intersect with the X-ray probe in the form of a liquid jet.

Figure 1:
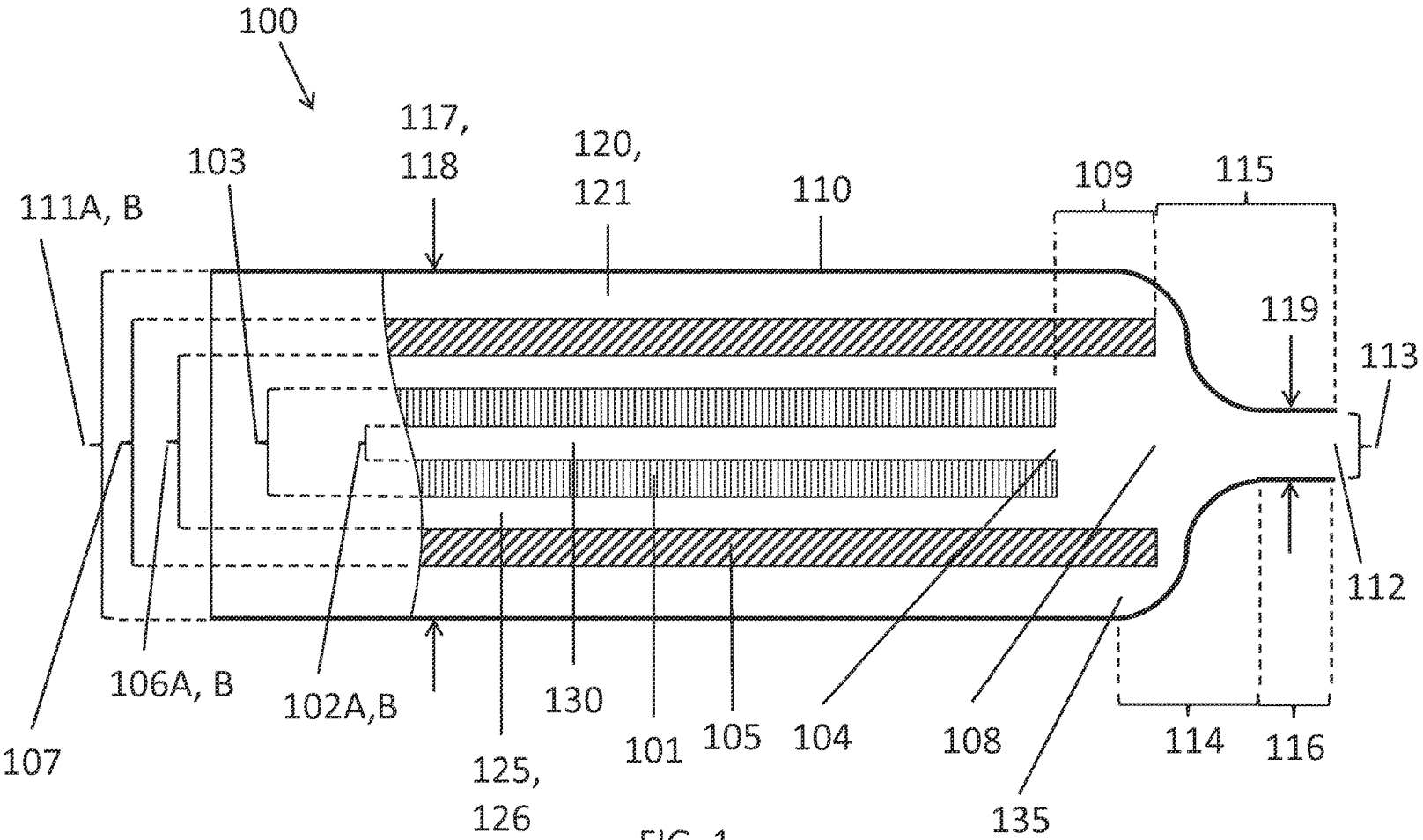
FIG. 1 illustrates a cross-section of a nozzle according to an embodiment of the invention.

A cross section of an exemplary nozzle assembly 100 according to an embodiment of the invention is shown in FIG. 1. This nozzle assembly 100 includes a central tube 101, an intermediate tube 105 and a housing 110. In one embodiment, the housing 110, the intermediate tube 105 and the central tube 101 may be arranged coaxially with respect to one another. In another embodiment, the housing 110, the intermediate tube 105 and the central tube 101 may be telescopic with respect to one another.

The housing 110 has an inlet 111A having an inner diameter 111B, an outlet 112 and a first channel 120 defined therebetween. The housing 110 includes a gas focusing aperture formed by a converging section 114 and an outlet section 116 of the housing 110. This gas focusing aperture that defines an outlet 112 that has an inner outlet diameter 113. In some embodiments, the housing 110 may have a circular cross section. In other embodiments, the housing 110 may have a square cross-section, or a rectangular cross-section. A longitudinal section 117 of the housing 110 and the inlet 135 to the gas focusing aperture 114, 116 may have an inner diameter 111B ranging from about 500 μm to about 1000 μm and may have an outer diameter 118 ranging from about 1000 μm to about 2000 μm. In an exemplary embodiment, outlet 112 may have an inner outlet diameter 113 of about 750 μm and an outer outlet diameter 119 of about 1000 μm. In an exemplary embodiment of the invention, the length of outlet section 116 may be about 300 μm. In another exemplary embodiment of the invention, the length of converging section 114 may be about 500 μm. In various embodiments, the housing 110 may be made from glass, stainless steel, Teflon, PEEK or the like. In an exemplary embodiment in which housing 110 is formed from glass, the gas focusing structure of the housing 110 may be formed by flame-melting the end of a glass tube to provide a desired shape for generating the gas focusing effect so as form a free jet. However, other methods of forming a shape for focusing may also be used.

The intermediate tube 105 is disposed within the first channel 120 of the housing 110. In one embodiment, an inner diameter 111B of the housing 110 may be greater than an outer diameter 107 of the intermediate tube 105 such that there is a coaxial space 121, between the housing 110 and the intermediate tube 105. This intermediate tube 105 has an inlet 106A and an outlet 108 and defines a second channel 125 therebetween. Intermediate tube 105 also has an inner dimension (e.g., diameter) 106B and an outer dimension (e.g., diameter) 107. In various embodiments, intermediate tube 105 may be made from glass, stainless steel, Teflon, PEEK or the like. In some embodiments, intermediate tube 105 may have a circular cross-section. In other embodiments, intermediate tube 105 may have a square cross-section, or a rectangular cross-section, where the inner dimension 106B is the minimum inner dimension. In another embodiment, intermediate tube 105 may have an inner diameter 106B ranging from about 200 μm to about 400 μm and an outer diameter 107 ranging from about 360 μm to about 600 μm. In operation, a second liquid may be delivered by intermediate tube 105 via the inlet 106A to a mixing region 109.

The central tube 101 is disposed within the second channel 125 of the intermediate tube 105. In one embodiment, the inner diameter 106B of the intermediate tube 105 may be greater than an outer diameter 103 of the central tube 101 such that there is a coaxial space 126 between the intermediate tube 105 and the central tube 101. The central tube has an inlet 102A and an outlet 104 and defines a third channel 130 therebetween. The outlet 104 of the central tube 101 is longitudinally spaced apart from the outlet 108 of the intermediate tube 105 such that the outlet 108 of the intermediate tube 105 is disposed between the outlet 104 of the central tube 101 and an inlet 135 of the gas focusing aperture 114, 116. Central tube 101 has an inner dimension (e.g., diameter) 102B and an outer dimension (e.g., diameter) 103. Central tube 101 may be made from glass, stainless steel, Teflon, PEEK or the like. In some embodiments, central tube 101 may have a circular cross-section. In other embodiments, central tube 101 may have a square cross-section, or a rectangular cross-section, where the inner dimension 102B is the minimum inner dimension. In an exemplary embodiment, central tube 101 may have an inner diameter 102B ranging from about 20 μm to about 50 μm and an outer diameter 103 ranging from about 100 μm to about 200 μm.

In operation, a first liquid or solution may be delivered by central tube 101 via the inlet 102A to a mixing region 109. It will be understood that other geometries for the housing 110 and the central and intermediate tubes 101, 105 may also be used.

Figure 2:
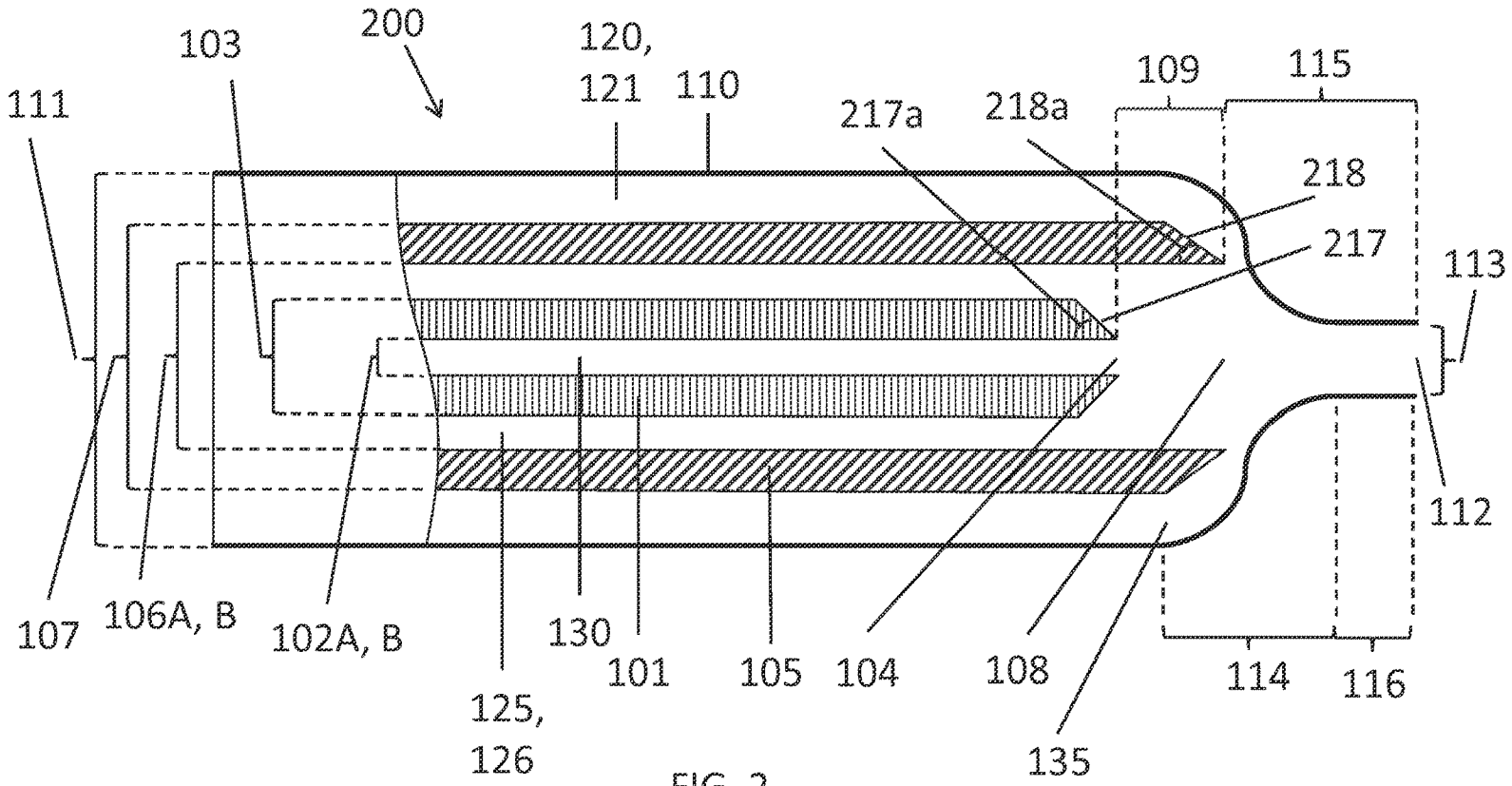
FIG. 2 illustrates a cross-section of a nozzle according to an embodiment of the invention.

In some embodiments of nozzle assembly 200, as shown schematically in FIG. 2, one or both of the central and intermediate tubes 101, 105 may have tapered or conical ends for smooth fluid flow. Central tube 101 may have a cone-shaped region 217 with angle 217*a* and intermediate tube 105 may have a cone-shaped region 218 with angle 218*a*. In exemplary embodiments where tubes 101 and 105 are glass, the cone-shaped region may be formed by mechanical grinding. Other methods for forming a cone-shaped region may also be used. In an exemplary embodiment of the invention, angle 217*a* may be between 15 degrees and 20 degrees. In an exemplary embodiment of the nozzle assembly 200, angle 218*a* is between 15 degrees and 20 degrees. Other angles may also be used. In general angle 217*a* may be greater than zero degrees and less than or equal to 90 degrees. In general angle 217*a* may be greater than zero degrees and less than or equal to 90 degrees. The nozzle end may be conical but it may be tapered with other profiles that may be performed using machining operations.

In exemplary devices according to FIGS. 1, and 2, outlet 104 of central tube 101 may be placed at a distance from outlet 108 of intermediate tube 105 to define a mixing region 109. The length of this mixing region 109 may be changed, as will be described later. The outlet 108 of intermediate tube 105 may be placed a distance 115 from outlet 112 of the housing 110. Arranging the outlet 108 of the intermediate tube 105 with respect to the housing 110 in this fashion provides a Gas Dynamic Virtual Nozzle ("GDVN")). The distance 115, and the pressure or flow rate of gas in channel 120 of the housing 110 may be chosen so as to provide collimation, directional control or focusing of the fluid output formed by the central and intermediate tubes 101, 105. This may be tested by observation of the behavior of a liquid as it emerges from the nozzle as distance 115 is varied and/or the pressure or the flow rate of the gas in housing 110 is varied. This may assist in determining the appropriate device parameters for operation. Examples of other nozzles that use gas focusing, and the operation of such nozzles are described in U.S. Pat. No. 8,272,576, U.S. published patent application no. 2013/0313336, U.S. published patent application no. 2014/0263693, and international patent application no. PCT/US14/35627, all of which are hereby incorporated by reference in their entirety.

As noted above, in operation, fluids may be introduced into the nozzle assembly using the central and intermediate tubes 101, 105. These fluids may be pure liquids, or solutions. In some embodiments, the fluid may include an analyte; such fluids preferably include a heterogeneous or homogeneous solution, or particulate suspension of the analyte in the second fluid. The fluid may include, but is not limited to, water and various solutions of water containing detergents, buffering agents, anticoagulants, cryoprotectants, lipids, and/or other additives as needed (e.g., sucrose) to form analyte-containing streams while maintaining the analyte in a desired molecular conformation, including crystalline forms. In certain embodiments, the fluids may include an aqueous solution of lipids (e.g, monoolein or monopalmitolein), and optional buffering agents, in amounts and concentrations sufficient to form a lipidic cubic phase. For example, see Landau et al., *Proc. Natl. Acad. Sci.* 1996, 93, 14532-535, which is hereby incorporated by reference in its entirety.

Examples analytes include, but are not limited to, proteins, protein complexes, peptides, nucleic acids (e.g., DNAs, RNAs, mRNAs), lipids, functionalized nanoparticles, viruses, bacteria, and whole cells. In certain embodiments, the analyte may be a protein complex, such as, but not limited to, Photosystem I (PSI). In certain other embodiments, the fluid may include an analyte (e.g., a protein such as PSI) and an aqueous solution of lipids (e.g, monoolein or monopalmitolein), and optional buffering agents, in amounts and concentrations sufficient to form a lipidic cubic phase.

The fluid is preferably supplied to the central and intermediate tubes 101, 105 at pressures ranging from about 2 to about 35 times atmospheric pressure; more preferably, at pressures ranging from about 10 to about 20 times atmospheric pressure; or pressures ranging from about 15 to about 20 times atmospheric pressure.

In an exemplary embodiment, a first fluid is introduce into central tube 101, and a second fluid is introduced into intermediate tube 105. The first fluid emerges from outlet 104 of central tube 101 and meets and mixes with the second fluid in a mixing region 109 within intermediate tube 105 defined by the positions of outlets 104 and 108, before both fluids are gas-focused (or collimated) by gas flowing in housing 110 and emerge from the GDVN nozzle as a free jet.

In an exemplary embodiment, a first fluid may be a solution of protein molecules or protein nano-crystals and may be fed through the central tube 101. The second fluid may be a solution of small molecules (reagents) fed through intermediate tube 105. When the first and second fluids mix, a reaction is triggered in mixing region 109. In an exemplary embodiment, the second fluid is controlled to flow faster than the first fluid, causing a hydrodynamic focusing of the first fluid flow at the outlet 104 of the central tube 101. In the exemplary embodiment, the diameter of the inner flow may decrease rapidly from about 20 μm to approximately 1 μm, providing a short diffusion distance for reagents from the outer fluid flow into the inner fluid flow and therefore a short mixing time. After the combined liquid flow leaves the end of the intermediate tube 105, it passes through the gas focusing aperture 114, 116 and may be accelerated by the focusing gas to form a free liquid jet with a diameter that may range from about 3 micrometers to about 7 micrometers. The jet may emerge from the nozzle assembly into a vacuum or into an ambient environment. The focusing is consistent with conservation of the product of area A and velocity V for incompressible flow. The nozzle assembly may be considered to be double-focusing. In the exemplary embodiment, the free jet may travel at a speed of about 10 m/s and may remain continuous for several hundreds of micrometers, before breaking up into small droplets. In an exemplary embodiment, the X-ray beam, such as one generated by an x-ray free electron laser (XFEL) or a beam generated by synchrotron radiation, probes the jet in the continuous region, rather than the droplet region.

Figure 3:
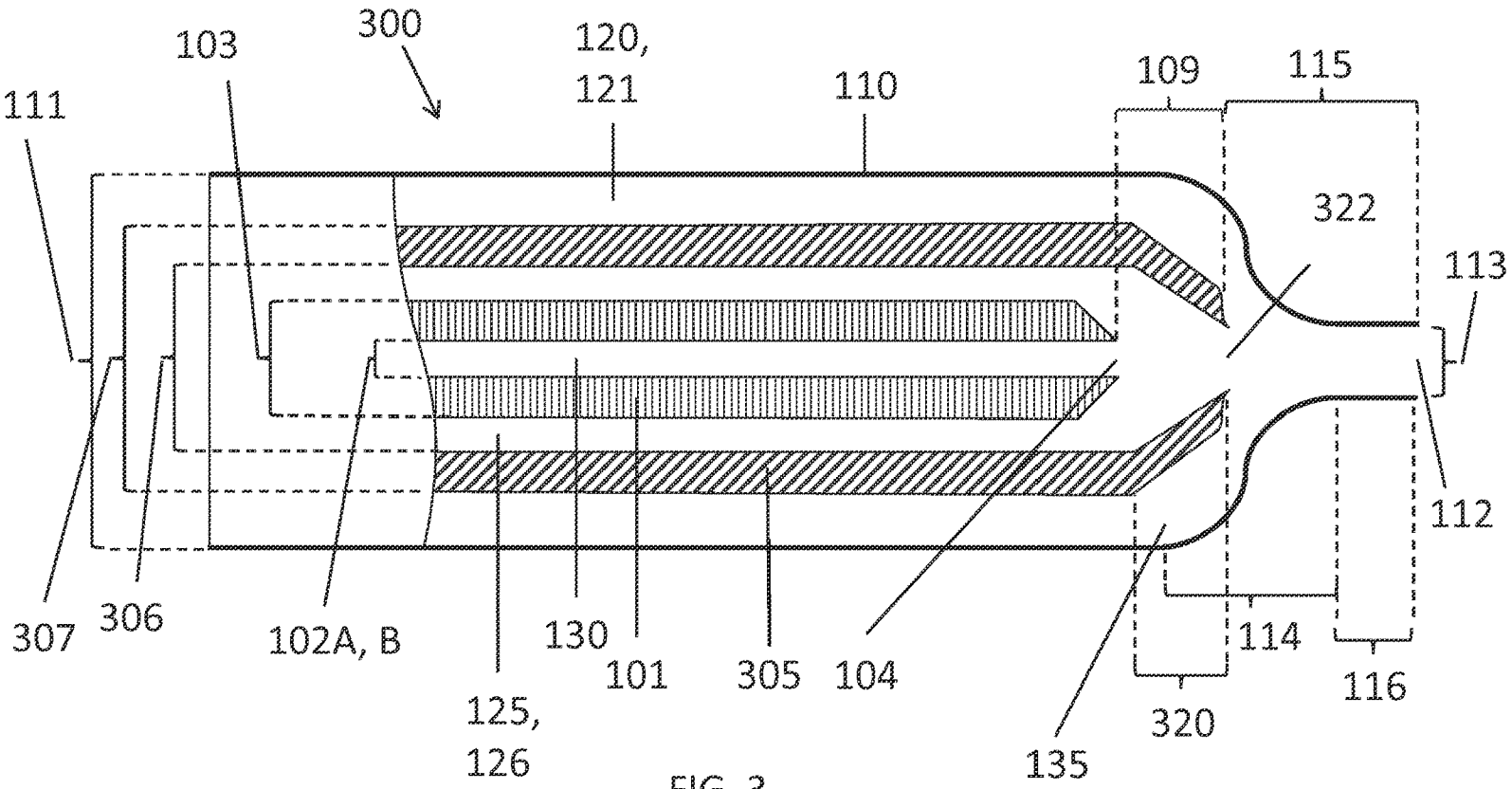
FIG. 3 illustrates a cross-section of a nozzle according to an embodiment of the invention.

FIG. 3 shows a cross-section of another exemplary nozzle assembly 300 according to an embodiment of the invention. In some applications, dilution of a first fluid delivered by central tube 101 as it diffuses after exiting the tube may not be desirable. To control the dilution of the fluid and to control the reaction between the first fluid and a second fluid introduced using intermediate tube 305, the end of intermediate tube 305 may be shaped so as to reduce the size of the outlet orifice. While the intermediate tube 305 has an outer dimension 307 and an inner dimension 306 at the inlet side, intermediate tube 305 has a converging section 320 and the output orifice has an inner dimension 322, as shown. In an exemplary embodiment of the invention, intermediate tube 305 may be glass and converging section may be formed using flame melting.

Nozzle assemblies 100, 200, 300 shown in FIGS. 1-3 may also be fabricated using micromachining or microfluidic approaches. For example, the invention provides a method for manufacturing the housing of the nozzle assembly using a multi-step process with photo-lithography. For example, the method of fabrication may include (a) soft-baking photoresist that is spin-coated in a desired pattern on a silicon wafer, (b) exposing the photoresist to UV light through a photomask, (c) chemically developing the photoresist, (d) hard-baking the photoresist to form a negative stamp, (e) pouring uncured poly(dimethylsiloxane) into the negative stamp to create a layer defining a cavity and a plurality of microchannels, and (f) fixing the layer between a top slab and a bottom slab of poly(methyl methacrylate. In other alternatives polymeric materials such as PDMS may be used in embodiments in which the central and intermediate tubes are fixed and control of time delay is accomplished via pressure/flow rate.

In a second aspect, the invention provides a method for producing a liquid jet that includes injecting a first fluid into the inlet 111A of the housing 110 of the nozzle assembly of any one of the nozzle assemblies according to the first aspect of the invention and thereby advancing the first fluid through the first channel 120 of the housing 110. Next, the method includes injecting a second fluid into an inlet 106A of the intermediate tube 105 and thereby advancing the second fluid through the second channel 125 of the intermediate tube 105. Then the method provides injecting a third fluid into an inlet 102A of the central tube 101 and thereby advancing the third fluid through the third channel 130 of the intermediate tube 105. And the method provides combining the second fluid and the third fluid in a mixing region 109 in the intermediate tube 105 between the outlet 104 of the central tube 101 and the outlet 108 of the intermediate tube 105. In one embodiment, first fluid may be a gas, the second fluid may be a liquid and the third fluid may be a liquid. In a further embodiment, the second fluid may be a solution of reagents and the third fluid may be a solution of protein molecules or protein nano-crystals.

In one embodiment, the second fluid may be advanced through the second channel of the intermediate tube at a faster rate than the third fluid is advanced through the third channel of the central tube.

In another embodiment, the method may also include hydrodynamically focusing the third fluid into a first free jet in the mixing region 109, via the advancing second fluid, as the third fluid advances through the outlet 104 of the central tube 101. In a further embodiment, the third fluid may be hydrodynamically focused from a flow diameter of about 20 μm to about 50 μm in the central tube 101 to a free jet diameter ranging from about 1 μm to about 3 μm in the mixing region 109.

In yet another embodiment, the method may also include advancing the combined second and third fluids through the outlet 108 of the intermediate tube 105 into a gas focusing aperture 114, 116 of the housing 110. Then the combined second and third fluids may be hydrodynamically focused into a second free jet in the gas focusing aperture 114, 116, via the advancing first fluid. In a further embodiment, the second free jet may have a diameter ranging from about 3 μm to about 7 μm. In a still further embodiment, the method may include advancing the second free jet through an outlet 112 in the gas focusing aperture 112, 116 at a rate of 10 m/s. In another embodiment, the method may provide for advancing the second free jet as a continuous stream for a distance of about 1 μm to about 300 μm beyond the outlet 112 in the gas focusing aperture 114, 116.

In a further embodiment, the method may further include directing a continuous region of the second free jet across a pulsed X-ray laser beam.

In another embodiment, the method may further include the step of adjusting a mix-to-probe delay time by increasing or decreasing a longitudinal distance between the outlet of the central tube and the outlet of the intermediate tube. A time delay may be controlled or adjusted by changing the distance between the outlet 104 of the central tube 101 and the outlet 108 of the intermediate tube 105. For example, the central tube 101 may be manually manipulated by hand to increase or decrease the distance between the outlet 104 and outlet 108 and held in place via a seal. Alternatively, this distance may be adjusted via automated mechanisms (e.g. linear actuator, micromanipulators, stepper motors and piezo transducer). In some embodiments, since the liquid flow speed is extremely fast after the liquid leaves the outlet 108 of intermediate tube 105 and forms a jet, and the mixing starts and finishes right after the outlet 104 of the central tube 101, the mix-to-probe time delay is the time it takes for the fluid from the central tube 101 after mixing with a fluid from the intermediate tube 105 in a mixing region 109 to intersect with the X-ray probe in the form of a liquid jet. Note reverse diffusion of the much larger species in the central tube into the intermediate tube may be negligible. By changing the position of the outlet 104 of central tube 101 relative to the outlet 108 of intermediate tube 105, the time for the liquid to travel this distance may be varied to select a desired time delay. For an exemplary embodiment of the invention with a flow rate for the device (F=0.05 μl/min for inner flow, and F=100 μl/min for outer flow), the velocity V=2*F/A=30 mm/s at the center of Newtonian flow, and the time delay is adjustable in the range of about 10 milliseconds to about 1000 milliseconds. Other flow rates may also be used. The flow rate of the fluid introduced via intermediate tube 105 is chosen to be greater than or equal to the flow rate of the fluid introduced via central tube 101 so as to provide focusing or collimation of the liquid emerging from central tube 101, i.e. preventing divergence of the inner liquid. The flow rates may also be chosen so as to control a reaction time for a reaction product to be formed in mixing region 109. The gas flow (or pressure) is then chosen so as to prevent divergence of the output from the entire nozzle. Flow rates may also be used to control "time delay." In some embodiments (e.g., lithographically formed), relative positions of the central and intermediate tubes 101, 105 may be fixed, thus operating conditions (e.g. flow rates, pressures) of liquids and gasses could be used to control reaction time and also "time delay."

In one embodiment, the mix-to-probe delay time may range from about 10 ms to about 1000 ms. In a further embodiment, a mixing time for mixing the second and third fluids may range from about 250 μs to about 1 ms. For different biomolecular processes, different mix-to-probe time delays may be required to access the varied kinetic time scales of interest. For a specific process, measurements at different time points are needed to sample different transient states. In embodiments of the invention in which the first and second fluids react to provide a reaction product, the ability to control the reaction time between the two fluids may be desirable.

In some embodiments, a pressurized gas may be inserted into the housing 110 such that gas flows through channel 120 of the housing 110 and exits through the outlet 112. The pressurized gas may include or consist essentially of an inert gas. The term "inert gas" as used herein means a gas which will not cause degradation or reaction of the fluids and/or any analytes. Such gases preferably contain limited levels of oxygen and/or water; however, the acceptable level of water and/or oxygen will depend on the fluids and/or analytes, and are readily apparent to one skilled in the art. Such atmospheres preferably include gases such as, but not limited to, hydrogen, nitrogen, carbon dioxide, helium, neon, argon, krypton, xenon, volatile hydrocarbon gases, or mixtures thereof. In certain embodiments, the inert gas includes nitrogen, helium, argon, or a mixture thereof. In certain embodiments, the inert gas comprises nitrogen. In certain embodiments, the inert gas includes helium. In certain embodiments, the inert gas comprises argon.

The pressurized gas may be supplied to the housing 110 at pressures ranging from about 2 to about 100 times atmospheric pressure; or about 2 to about 50 times atmospheric pressure; or about 2 to about 25 times atmospheric pressure; or about 2 to about 15 times atmospheric pressure; or about 2 to about 10 times atmospheric pressure; more preferably, at pressures ranging from about 2 to about 5 times atmospheric pressure; or pressures ranging from about 3 to about 5 times atmospheric pressure; or pressures ranging from about 5 to about 100 times atmospheric pressure; or about 5 to about 50 times atmospheric pressure; or about 5 to about 25 times atmospheric pressure; or about 5 to about 15 times atmospheric pressure; or about 5 to about 10 times atmospheric pressure; or pressures ranging from about 9 to about 100 times atmospheric pressure; or about 9 to about 50 times atmospheric pressure; or about 9 to about 25 times atmospheric pressure; or about 9 to about 15 times atmospheric pressure.

In one embodiment, the housing gas pressure may be about 150 psi, and the liquid may be about 1.4 molar sucrose solution with one atmosphere of back pressure on the liquid. The inner diameter 102B of the central tube 101 may be about 50 microns, and the continuous liquid jet may narrow to a diameter of about 15 microns.

In one embodiment, the method may include applying a gas back-pressure on the first or second fluid. Certain fluids with high viscosity, such as lipidic cubic phase (LCP) (−500 Pa-s) or 1.4 M sucrose in water solution (0.081 Pa-s at 25° C.) may be inserted into the nozzle and thereby result in a microscopic linear liquid jet. Many other fluids are capable of resulting in microscopic linear liquid jets as well. The gas back-pressure may assist in transmitting viscous liquids through the outlet 112 that otherwise may have been incapable of extrusion.

"High viscosity" as used herein means significantly higher than the viscosity of water (1.00 centipoise at 20° C.) (e.g, oils such as olive oil (84 centipoise) and castor oil (986 centipoise) would be considered high viscosities). For laminar flow through a tube (Poiseuille flow), the volumetric flow rate is inversely proportional to the fluid viscosity, directly proportional to the pressure drop per unit length along the tube, and varies with the fourth power of a tube radius. Accordingly, for a given pressure applied front-to-back along the tube, the volumetric flow rate decreases with increasing viscosity, and dramatically so as the tube radius is decreased. It is therefore the tube diameter and the required pressure that may set an effective upper limit on the viscosity that can be accommodated.

The gas back-pressure may be applied in a variety of ways. For example, in one embodiment, high pressure tubing may be coupled to one or more reservoirs containing the first or second fluids, where the reservoir is coupled to the central tube 101 or intermediate tube 105. The fluid may be inserted into the reservoir with a syringe, or before assembly, or by any other method known to one in the art. A gas pressure can be applied into the high pressure tubing by methods familiar to those skilled in the art. The gas pressure may be applied in the range of about 600 psi to about 2000 psi. In one embodiment dry nitrogen gas may be applied in the range of 600 to 2000 psi. Other sources of gas pressure are well known and may be used. Higher or lower pressures may be applied depending on the material used for the fluid and the desired flow rate. Depending on the pressure applied, flow rates may be from about 1 nL/min to about 10 μL/min; however, higher and lower flow rates may be possible. In certain embodiments, the flow rate may be less that about 100 nanoliters/minute.

In other embodiments, lower gas pressures may be used, ranging from about 1 atm to about 100 atm. For example, 1 atm of pressure may be used to extrude 1.4M sucrose in water solution in a linear continuous stream.

Various embodiments may provide a hydraulic pressure amplification stage device that may permit extension of the continuous liquid jet. In some embodiments, the fluid flow rate may be adjusted from about 0 nL/min to about 200 nL/min by adjusting the back pressure. In other embodiments, the hydraulic stage may be used in combination with a High Pressure Liquid Chromatography ("HPLC") pump to permit operation at a constant flow rate.

Thus, the nozzle assembly may further include (a) a hydraulic stage having a first end and a second end, where the hydraulic stage comprises a housing defining a cavity between the first end and the second end of the hydraulic stage, a primary plunger disposed in the cavity and a secondary plunger, (b) a pressurization system coupled to the hydraulic stage at the first end, where the primary plunger has a first end in fluid communication with the pressurization system and has a second end in mechanical communication with a secondary plunger, (c) a reservoir bore defined in the housing of the hydraulic stage, where the reservoir bore has a first end and a second end, where the first end of the reservoir bore is configured to receive the second end of the primary plunger, where the secondary plunger is disposed within the reservoir bore and (d) a nozzle assembly comprising a housing, a gas tube and a nozzle capillary, where the gas tube has a first end, a second end and a gas aperture defined at the second end of the gas tube, where the nozzle capillary is partially disposed within the gas tube and is substantially coaxial with the gas tube, where the nozzle capillary has a first end and a second end, where the first end of the nozzle capillary is in fluid communication with the second end of the reservoir bore.

Example 1—Liquid Mixing Jet for XFEL Study of Chemical Kinetics

Synopsis

A novel method for time-resolved study of chemical kinetics using a windowless mixing nozzle assembly for forming and directing a jet at an X-ray Free-electron Laser ("XFEL") is described and demonstrated. A short mixing time may provide good time resolution; the design may introduce controllable time delays between the initiation of a chemical reaction, and detection of transient structures by an XFEL beam pulse. Applications may include time-resolved enzyme-substrate imaging or protein folding.

Overview

Several liquid sample injection methods have been developed to satisfy the requirements for serial femtosecond X-ray nanocrystallography ("SFX") that may enable radiation damage-free determination of molecular structure at room temperature. Time-resolved nanocrystallography combines structure analysis with chemical kinetics by determining the structures of the transient states and chemical kinetic mechanisms simultaneously. A nozzle assembly that may be a windowless liquid mixing jet device has been designed for this purpose and may achieve fast, uniform mixing of substrates and enzymes in the jet within 250 μs, with an adjustable delay between mixing and probing by the XFEL beam of up to one second for each frame of a "movie." The principle of the nozzle assembly is illustrated using numerical simulation, and experimental results are presented using a fluorescent dye.

Here chemical processes are considered (such as a substrate-enzyme interaction, or protein folding or unfolding) where the rapid mixing of two solutions initiates a reaction. The mixing time may then set the time resolution of the structural measurements, which will use femtosecond pulses of an X-ray laser. These short pulses may outrun radiation damage, allowing the study of protein molecules or nanocrystals at room temperature, alleviating concerns of damage due to freezing.

Here a liquid mixing jet device is demonstrated that mixes two liquids inside a nozzle assembly and then injects them as a free jet into vacuum to achieve fast mixing and an adjustable time delay, while addressing the requirements of XFEL experiments. A coaxial liquid flow structure is utilized for mixing two liquids, then a gas focusing mechanism is used to form a continuous thin liquid jet while avoiding nozzle clogging problems. Mixer structure and fabrication is described, followed by numerical simulations and experimental results using a fluorescent dye to measure the performance of the mixing nozzle.

2. Fluid Mechanics and Device Design

Figure 4:
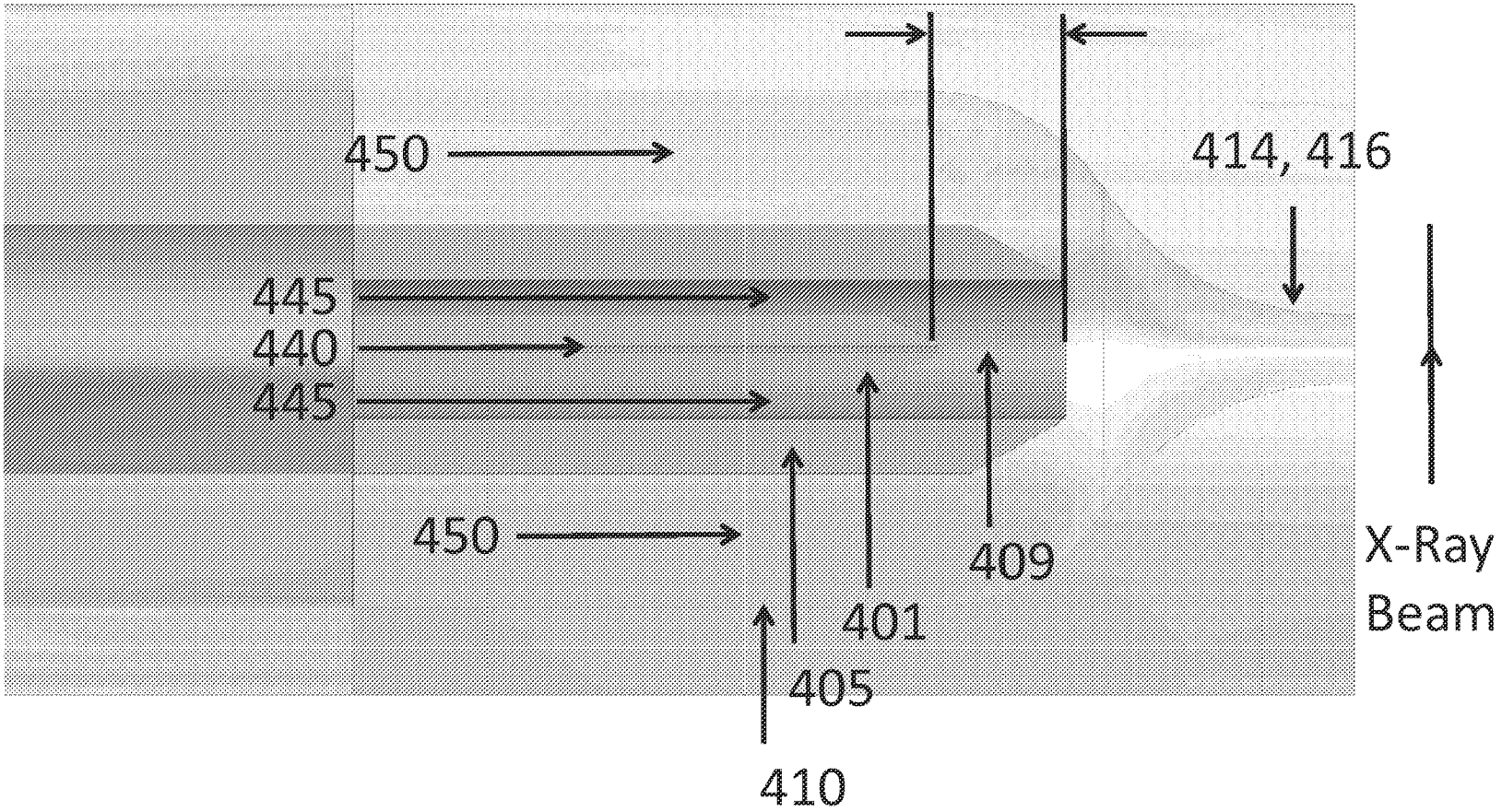
FIG. 4 is an illustration of a partial cross-section of a nozzle according to an embodiment of the invention.
Figure 5:
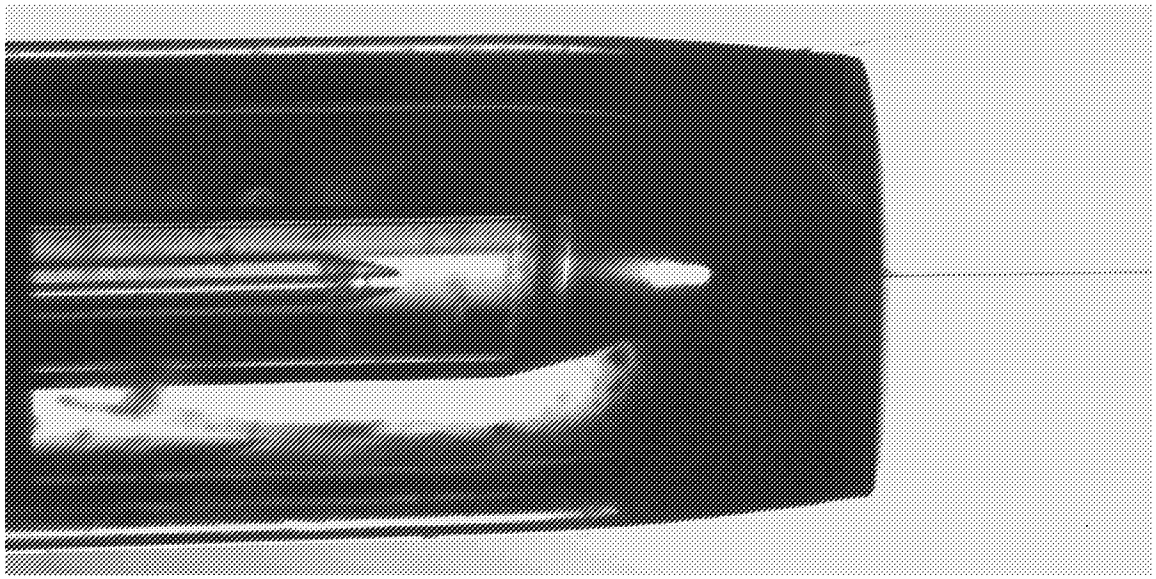
FIG. 5 is a photograph of an exemplary embodiment of a nozzle according to the invention.

A schematic of the nozzle assembly is shown in FIG. 4. The nozzle assembly consists of three coaxial telescopic tubes, namely a central tube with 20 micron inner diameter ("ID") and 100 microns outer diameter ("OD") containing liquid 1, an intermediate tube with 200 micron ID and 360 micron OD containing liquid 2, and an outer gas focusing tube. By terminating the central tube 401 short of the intermediate tube 405 and housing 410 (which may be about the same length, terminating in a GDVN nozzle (ref)), a third fluid 440 in the central tube 401 emerges to meet and mix with a second fluid 445 before both liquids are focused by a first fluid 450 in the form of a gas emerging from the GDVN nozzle as a free jet. In an exemplary embodiment, both central and intermediate tubes 401, 405 have a cone shaped end for smooth fluid flow. The gas focusing aperture 414, 416 has an ID of 750 microns and an OD of 1000 micrometers, and its end is flame melted and formed to a specific shape for generating the gas focusing effect needed to form a free jet.

FIG. 4 shows the geometry and principle of an exemplary liquid mixing jet device is shown. Two liquids, fed through the central tube 101 and the intermediate tube 105, respectively, mix at the end of the central tube 101 in a mixing region 109. After an adjustable delay, flowing between the end of central tube 401 and end of intermediate tube 405, the flow goes through a gas focusing process and forms a thin jet. The time delay can be changed by changing the position of the central tube 401 relative to the intermediate tube 405.

As shown in FIG. 4, the solution of protein molecules or protein nano-crystals is fed through the central tube 401, meeting with a solution of small molecules (reagents) which trigger the reaction when the third liquid 440 and second liquid 445 mix. The outer second fluid 445 flows much faster than the inner third liquid 440, causing a hydrodynamic focusing of the inner third liquid flow at the outlet 404 of the central tube 401 or capillary. The diameter of the inner flow may decrease rapidly from about 20 micrometer to approximately 1 μm, providing a short diffusion distance for reagents from the outer flow into the inner flow and therefore a short mixing time.

After the combined liquid flow leaves the outlet 408 of the intermediate tube 405 into vacuum, it passes through a gas focusing aperture 414, 416 and is accelerated by the focusing gas 450 to form a free liquid jet with a diameter that may range from about 3 micrometers to 7 micrometers. The focusing is consistent with conservation of the product of area A and velocity V for incompressible flow. The nozzle assembly may therefore be double-focusing. The free jet travels at a speed of about 10 m/s and remains continuous for several hundreds of micrometers, before breaking up by a necking instability into small droplets, similar to a Rayleigh jet. The XFEL beam probes the jet in the continuous region, rather than the droplet region.

For different biomolecular processes, different mix-to-probe time delays are required to access the varied kinetic time scales of interest. For a specific process, measurements at different time points are needed to sample different transient states. An adjustable time delay may be achieved by changing the distance between the outlet 404 of the central tube 401 and outlet 408 of the intermediate tube 405. Since the liquid flow speed is extremely fast after the liquid leaves the outlet 408 of intermediate tube 405 and forms a jet, and the mixing starts and finishes right after the outlet 404 of the central tube 401, it is reasonable to consider the mix-to-probe delay time as the time the liquid flow takes to travel from the outlet 404 of the central tube 401 to the outlet 408 of the intermediate tube 405. By changing the position of the central tube 401 relative to the intermediate tube 405, the time for the liquid to travel this distance may be varied to set a desired time delay. For a typical flow rate for this device (F=0.05 μl/min for inner flow, and F=100 μl/min for outer flow), the velocity V=2*F/A=30 mm/s at the center of Newtonian flow, and the delay time is adjustable in the range of 10 to 1000 milliseconds.

3. Experiments and Simulations

Figure 6:
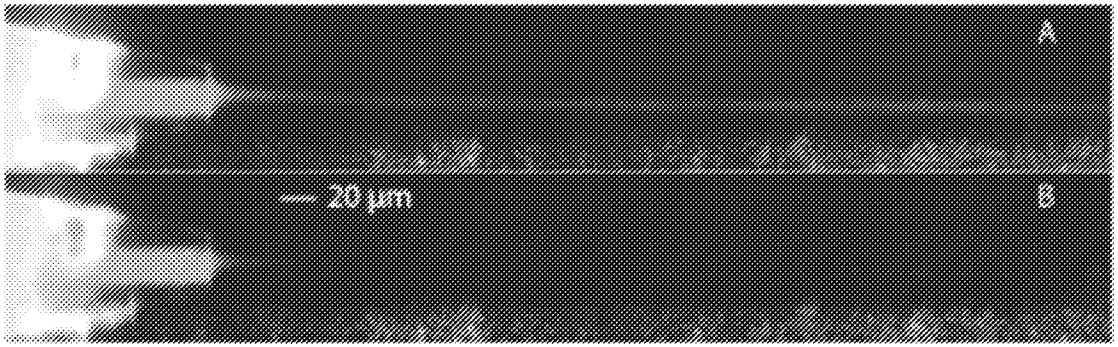
FIG. 6 is a photograph showing a mixing experiment according to an embodiment of the invention.

Fluorescence experiments were carried out to demonstrate the fluid dynamics of the mixing process as shown in FIG. 2. The fluorescent dye sulforhodamine 101 solution was fed through the central tube 401 with a syringe pump at a flow rate 0.05 μl/min, stimulated by a 528 nm laser, while water is fed through the intermediate tube 405 at a flow rate of 100 μl/min (FIG. 6, upper frame A). At this condition, the inner flow is focused down to about 3 μm in diameter within about 20 μm of axial travel. This focusing distance may be decreased further to 1 μm by using a higher flow rate for the outer flow and a lower flow rate for the inner flow. In FIG. 6, lower frame B, instead of water, a solution of sodium iodide was fed through the intermediate tube to quench the fluorescence upon mixing. This fast interaction occurs much more rapidly than diffusion, and so can be used to measure the time taken for the two fluids to diffuse and mix. (Reaction times between biomolecules may be much longer). The picture shows that the fluorescence is completely quenched within about 20 μm of axial travel. Based on the flow speed, the elapsed time may be less than 1 ms. Hence the upper limit of the mixing time is about 1 ms for this flow rate. Under these flow conditions, simulations (below) reveal that the actual mixing time is much shorter than this upper limit. An even shorter upper limit of the mixing time down to less than 300 μs may also be achieved by decreasing the flow rate of the inner fluid, and increasing the flow rate of the outer fluid.

As shown in FIG. 6, this fluorescence experiment illustrates the mixing process. The field of view shows only the central tube 401 at the mixing region 109 indicated in FIG. 2. Specifically, FIG. 6, upper frame A, shows fluorescent dye in the central tube and water in the intermediate tube. FIG. 6, lower frame B, shows fluorescent dye disposed in the central tube and quencher disposed in the intermediate tube 405. Quenching represents the mixing process.

Figure 7:
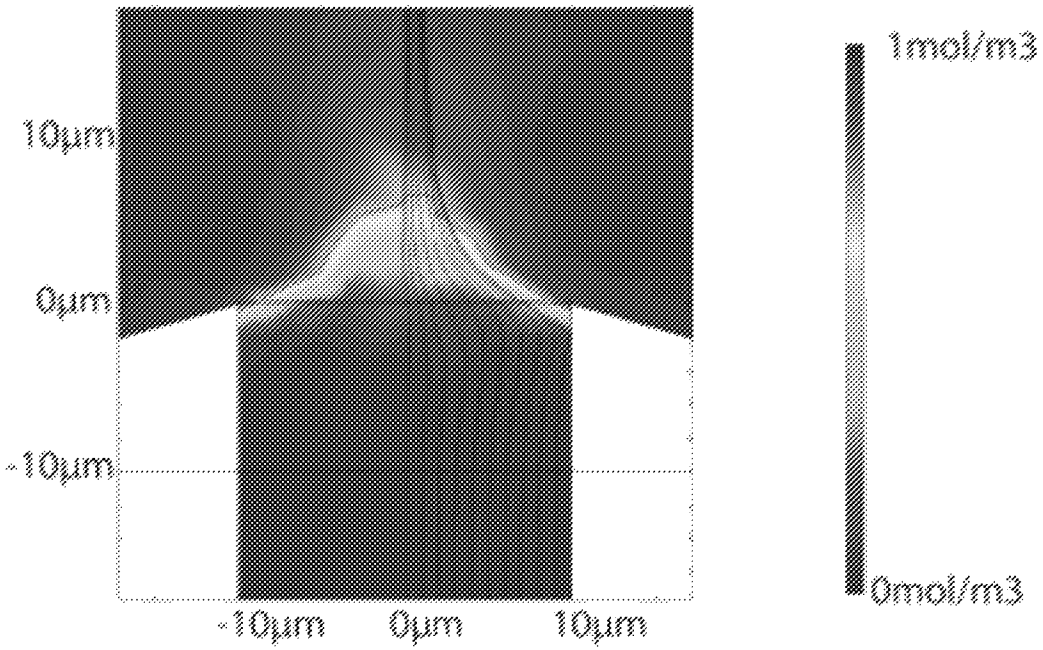
FIG. 7 is a plot illustrating numerical simulations of diffusion during mixing according to an embodiment of the invention.

In addition, numerical simulation of the mixing was carried out as shown in FIG. 7. A flow model was set up with the geometry of this device, in which the central tube was fed with water at 0.1 μl/min and the intermediate tube was fed with water solution with 1 mol/$m^3$ of solvent (with diffusion coefficient $3.0\times10^{-6}$ $cm^2$/s). If complete mixing is defined to be when the inner flow reaches 70% of the concentration of the solute (0.7 mol/$m^3$), then a contour of the mixing criteria may be drawn, as shown in FIG. 7. The mixing time can be defined as the standard deviation of the time every streamline takes from upstream to crossing the mixing criteria contour. Calculation shows the time to be about 150 μs.

Numerical simulations shown in FIG. 7 illustrate the diffusion into the inner flow during the mixing process. The colour scale represents concentration ranging from about 0 to about 1 mol/$m^3$. Contours represent concentrations of 0.7 mol/$m^3$, the mixing criteria and streamlines show the inner flow.

4. Conclusion

The double-focusing design of the nozzle assembly presented here may achieve fast and uniform mixing of two solutions on a molecular scale within 250 microseconds while keeping the sample consumption low. This design may also satisfy the high replenishment rate and sample environment requirements for XFEL experiments, enable radiation damage-free studies of chemical kinetics at room temperature, and may be directly adopted by the LCLS beamline for experiments on time-resolved studies of biomolecular interactions.

The above detailed description describes various features and functions of the disclosed nozzle assemblies and methods for producing a liquid jet with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A nozzle assembly comprising:

a housing having an inlet and an outlet and a first channel defined therebetween, wherein the housing includes a gas focusing aperture that defines the outlet of the housing;

a non-converging intermediate tube disposed within the first channel of the housing, wherein the non-converging intermediate tube has an inlet and an outlet and defines a second channel therebetween, wherein the outlet of the non-converging intermediate tube is beveled; and a dynamically adjustable, non-converging central tube disposed within the second channel of the non-converging intermediate tube, wherein the non-converging central tube has an inlet and an outlet and defines a third channel therebetween, wherein the outlet of the non-converging central tube is beveled and is longitudinally adjustable relative to and spaced apart from the outlet of the non-converging intermediate tube such that the outlet of the non-converging intermediate tube is disposed between the outlet of the non-converging central tube and an inlet of the gas focusing aperture, wherein the gas focusing aperture includes a convergent section configured to focus fluid output from the non-converging intermediate tube and the non-converging central tube.

2. The nozzle assembly of claim 1, wherein the housing, the non-converging intermediate tube and the non-converging central tube are arranged coaxially with respect to one another.

3. The nozzle assembly of claim 1, wherein an inner diameter of the housing is greater than an outer diameter of the non-converging intermediate tube such that there is a coaxial space between the housing and the non-converging intermediate tube.

4. The nozzle assembly of claim 1, wherein an inner diameter of the non-converging intermediate tube is greater than an outer diameter of the non-converging central tube such that there is a coaxial space between the non-converging intermediate tube and the non-converging central tube.

5. The nozzle assembly of claim 1, wherein the non-converging central tube has an inner diameter ranging from about 20 μm to about 50 μm and an outer diameter ranging from about 100 μm to about 200 μm.

6. The nozzle assembly of claim 1, wherein the non-converging intermediate tube has an inner diameter ranging from about 200 μm to about 400 μm and an outer diameter ranging from about 360 μm to about 600 μm.

7. The nozzle assembly of claim 1, wherein the gas focusing aperture has an inner diameter ranging from about 500 μm to about 1000 μm and an outer diameter ranging from about 1000 μm to about 2000 μm.

8. The nozzle assembly of claim 1, wherein the outlet end of the non-converging central tube and the outlet end of the non-converging intermediate tube are conical.

9. The nozzle assembly of claim 1, wherein a common longitudinal axis of the non-converging intermediate tube and the non-converging central tube is collinear with a longitudinal axis of the gas focusing aperture.

10. The nozzle assembly of claim 1, wherein the non-converging central tube is moveable relative to the non-converging intermediate tube to increase or decrease a longitudinal distance between a central tube outlet and an intermediate tube outlet.

11. A method for producing a liquid jet comprising:

injecting a first fluid into the inlet of the housing of the nozzle assembly of claim 1 and thereby advancing the first fluid through the first channel of the housing;

injecting a second fluid into an inlet of the non-converging intermediate tube and thereby advancing the second fluid through the second channel of the non-converging intermediate tube;

injecting a third fluid into an inlet of the non-converging central tube and thereby advancing the third fluid through the third channel of the non-converging intermediate tube; and combining the second fluid and the third fluid in a mixing region in the non-converging intermediate tube between the outlet of the non-converging central tube and the outlet of the non-converging intermediate tube.

12. The method of claim 11 further comprising:

hydrodynamically focusing the third fluid into a first free jet in the mixing region, via the advancing second fluid, as the third fluid advances through the outlet of the non-converging central tube.

13. The method of claim 11, wherein the third fluid is hydrodynamically focused from a flow diameter of about 20 μm to about 50 μm in the non-converging central tube to a free jet diameter ranging from about 1 μm to about 3 μm in the mixing region.

14. The method of claim 11, wherein the second fluid is advanced through the second channel of the non-converging intermediate tube at a faster rate than the third fluid is advanced through the third channel of the non-converging central tube.

15. The method of claim 11, further comprising:

advancing the combined second and third fluids through the outlet of the non-converging intermediate tube into a gas focusing aperture of the housing; and hydrodynamically focusing the combined second and third fluids into a second free jet in the gas focusing aperture, via the advancing first fluid.

16. The method of claim 11, wherein the second free jet has a diameter ranging from about 3 μm to about 7 μm.

17. The method of claim 11, further comprising: advancing the second free jet through an outlet in the gas focusing aperture at a rate of 10 m/s.

18. The method of claim 11, further comprising:

advancing the second free jet as a continuous stream for a distance of about 1 μm to about 300 μm beyond the outlet in the gas focusing aperture.

* * * * *